US006546761B2

(12) United States Patent
Ruoff et al.

(10) Patent No.: US 6,546,761 B2
(45) Date of Patent: Apr. 15, 2003

(54) COMPOUND NEEDLE WITH IMPROVED SLIDER

(75) Inventors: Klaus Ruoff, Albstadt (DE); Jürgen Schneider, Balingen-Frommern (DE); Andreas Dietz, Balingen (DE)

(73) Assignees: Groz-Beckert KG, Albstadt (DE); Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/176,076

(22) Filed: Jun. 21, 2002

(65) Prior Publication Data

US 2003/0019250 A1 Jan. 30, 2003

(30) Foreign Application Priority Data

Jun. 23, 2001 (DE) ..... 101 30 365

(51) Int. Cl.[7] ..... D04B 35/06
(52) U.S. Cl. ..... 66/120
(58) Field of Search ..... 66/120, 116, 123

(56) References Cited

U.S. PATENT DOCUMENTS 3,584,481 A * 6/1971 Hayashi ..... 66/120
4,043,153 A * 8/1977 Lindner et al. ..... 66/120
5,937,673 A * 8/1999 Shima ..... 66/120
6,233,977 B1 * 5/2001 Schuler et al. ..... 66/120
6,339,942 B1 * 1/2002 Majer et al. ..... 66/120
6,422,045 B1 * 7/2002 Morita et al. ..... 66/120

FOREIGN PATENT DOCUMENTS

| | | | | |
|---|---|---|---|---|
| DE | 2 228 547 | | 12/1972 | |
| DE | 29 28 282 | A1 | 4/1980 | |
| DE | 31 51 150 | A1 | 7/1983 | |
| DE | 4430705 | A1 * | 3/1996 | ..... 66/120 |
| EP | 09875614 | A2 | 11/1998 | |
| EP | 881314 | A2 * | 12/1998 | ..... 66/120 |
| EP | 1 039 003 | A1 | 9/2000 | |

* cited by examiner

*Primary Examiner*—Danny Worrell
(74) *Attorney, Agent, or Firm*—Venable; Norman N. Kunitz

(57) ABSTRACT

A compound needle (1) is provided with a slider (8) having two slider springs (11, 12), whose ends constitute an open funnel pointing toward the hook (3). The ends, or legs (21, 22), constituting the funnel, are flattened. Therefore, starting at a starting point, the thickness of the material is reduced in the tapered area (29) toward the ends of the slider springs (11, 12). By means of this a correct functioning of the compound needle is also provided if the slider (8) is not completely centered. Moreover, it is possible to improve the easy movement of the slider (8) in the slider slit in that the funnel, formed by the legs (21, 22), can be embodied to be narrower at a constant width, than without the taper of the slider springs (11, 12).

7 Claims, 4 Drawing Sheets

COMPOUND NEEDLE WITH IMPROVED SLIDER

Figure 1:
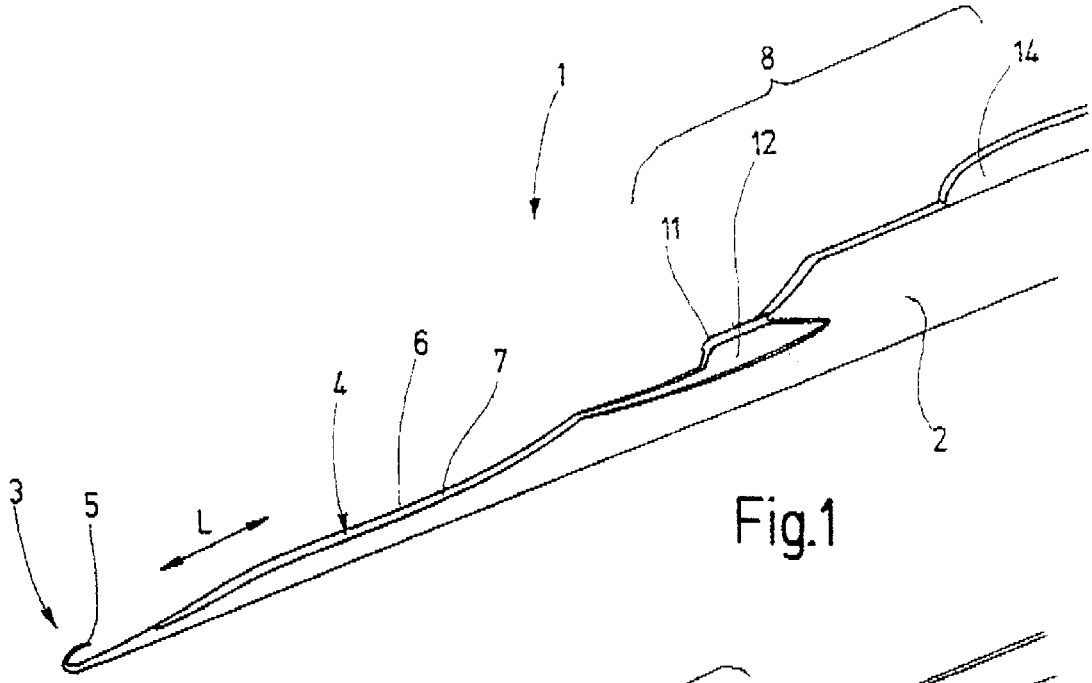

The invention relates to a compound needle with a slider used for opening and closing the yarn chamber.

A compound needle with a two-section slider is known from DE 25 37 502. The compound needle has an elongated base body, which makes a transition into a hook at one end. A slider slit, in which the slider is arranged, starts at a location opposite the open side of the hook. The slider has two slider springs which rest flat against each other and together can be pushed toward the hook and away from it in the slit. The ends of the two slider springs are bent away from each other at their edges facing the hook in order to form a funnel for receiving the hook tip.

In the course of operating the needle it is necessary to assure that the hook tip always dependably finds its way into the funnel during opening and closing of the yarn chamber. If the slider springs contact the hook tip because of external influences or because of advanced wear, malfunctions will occur.

A compound needle is known from DE 199 13 822 C2, whose slider is also composed of two slider springs. Together they form a funnel at their free ends, but are otherwise convexly bent away from each other. The lateral bulge of the slider springs is used for centering it in the slider slit, so that the funnel formed by the slider springs can be pushed well centered over the hook tip.

A particularly great functional dependability in respect to centering the hook in the funnel is obtained when the funnel is embodied to be as large as possible. However, an enlargement of the funnel entails difficulties, because the funnel enters the slider slit when the slider is retracted. Here, funnels of increased size tend to increase the friction, which in turn can result in wear and/or heat generation. This in turn negatively affects the ability of the compound needle as a whole to function, wherein in the extreme case the slider springs can no longer be moved with the required ease.

Based on this it is the object of the invention to create a compound needle which, along with reduced slider friction, permits a high degree of operational dependency.

This object is attained by means of a compound needle having the characteristics of claim 1.

The compound needle of the invention has a slider with two slider springs. The slider can be made of one piece or of several individual elements (slider spring, slider body), which are releasably or permanently connected with each other. The ends of the slider springs are embodied to be tapered. Thus, the thickness of the slider springs continuously decreases towards the ends of the slider springs in a tapered area, which is limited to the funnel area. With a given exterior funnel width, this results in a larger interior funnel width, so that the dependability with which the slider is pushed over the hook increases even under difficult conditions and with advanced wear. Since the exterior contour of the funnel no increase of friction occurs. On the contrary, it is possible in the reverse manner to reduce the exterior width of the funnel, so that a funnel is obtained with the same funnel width as was found in connection with customary compound needles.

It is also possible to make use of both the effects described here separately, namely an increase of the inner width of the funnel, combined with a reduction of its exterior width. In comparison with customary compound needles, such a compound needle shows decreased friction and improved functional dependability.

It can be practical to provide only one of the slider springs with a taper and to embody the other one in the customary manner with a non-tapered end. This is particularly sensible in those cases in which the slider is subjected to a known lateral loop tension or other laterally acting force. However, in general a symmetrical (mirror symmetrical) embodiment of the slider springs is preferred, so that the dependable aim of the slider and the hook is generally increased.

The tapering of the slider springs is expressed in a reduction of the thickness of the slider springs measured transversely in respect to the movement direction and at right angles in respect to the lateral faces of the compound needle. In this case the reduction in thickness is continuous. The free ends of the slider springs are preferably rounded with a very small radius of curvature. Preferably no sharp edges are provided at the free end of the slider spring. This prevents damage or injury to the knitted fabric and/or to the yarn.

The tapered area is preferably shorter than the funnel. In other words, the tapering of the slider springs is limited to their area in which they are spread apart from each other.

It is also possible to limit the taper to an even shorter section, for example merely to a portion of the funnel. This increases the stability of the slider springs in their funnel area.

The slider springs can have an approximately rectangular cross section in their tapered area. This is achieved by a simple flattening of the slider springs which are bent away from each other. Alternatively it is possible to limit the taper to a central portion of the slider spring, for example, so that it is then provided with a depression for receiving the hook on its inside, which deepens and widens in the direction toward the free ends of the slider springs. This measure, too, can improve the properties of the needle, as recited above, wherein an increased stability of the slider springs is achieved in addition.

Further details of advantageous embodiments of the invention ensue from the description, the drawings, or the dependent claims.

Figure 2:
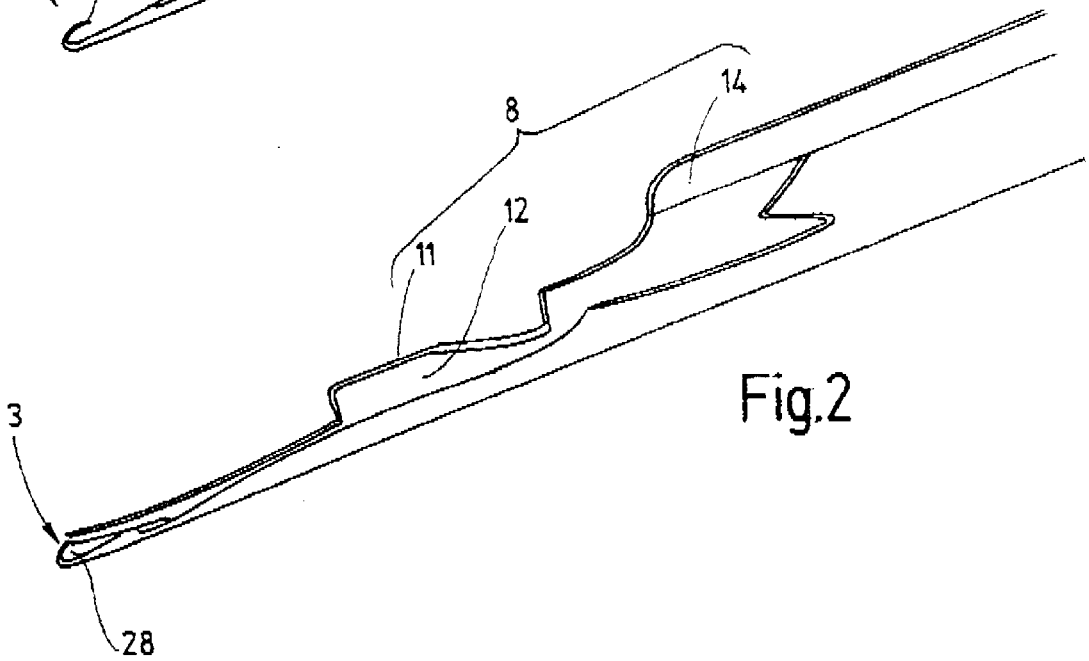
Figure 3:
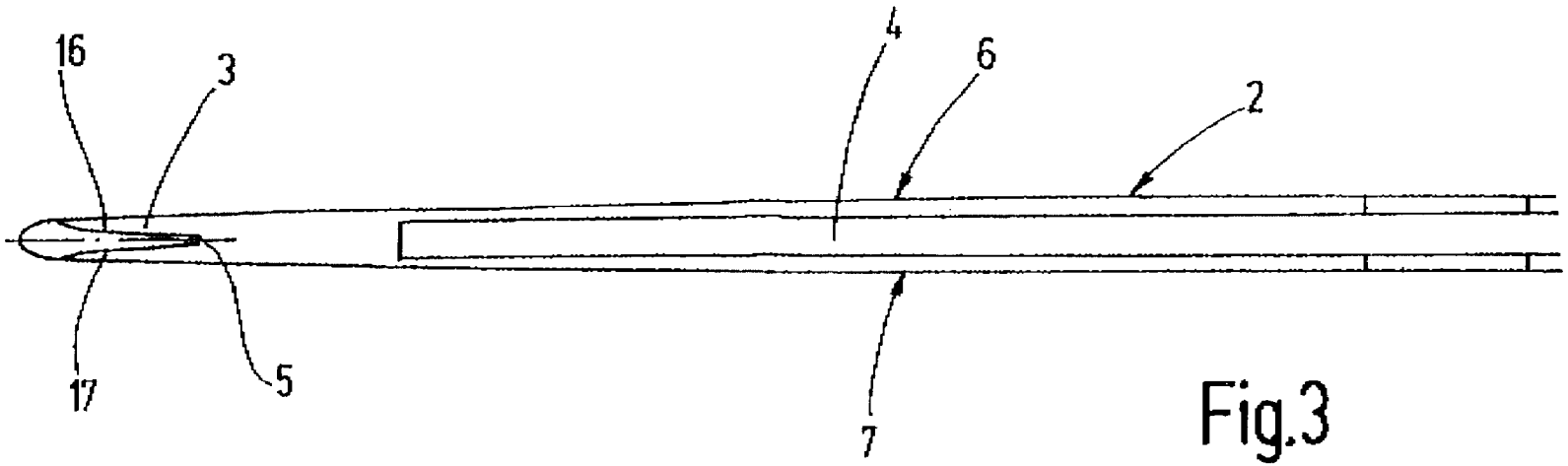
Figure 4:
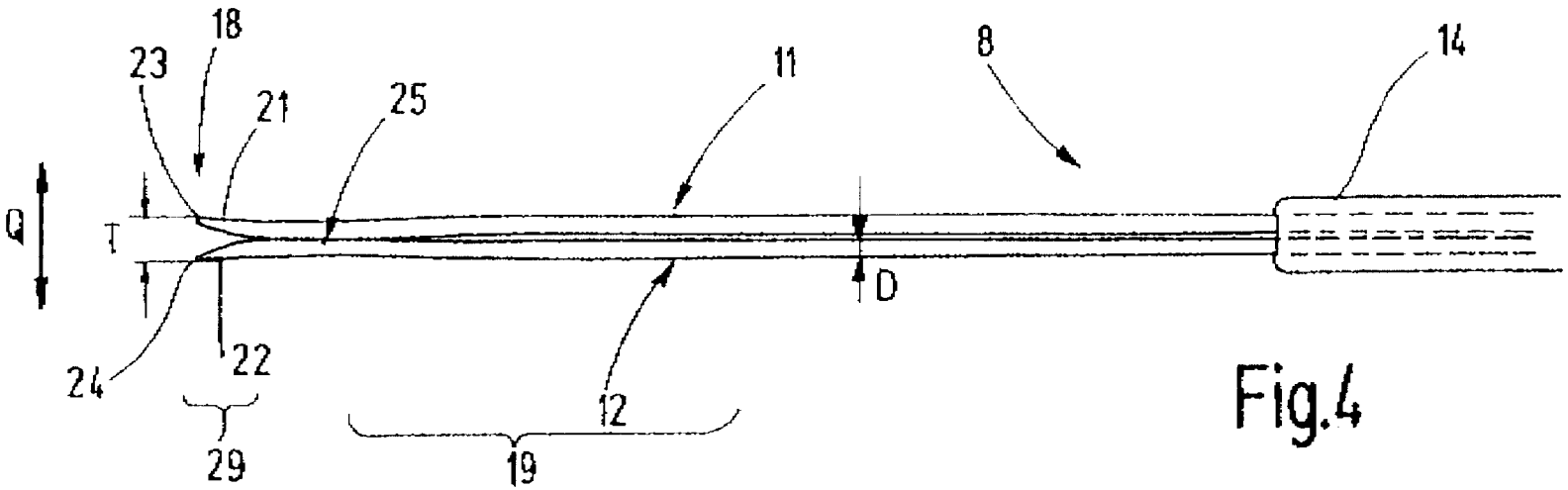
Figure 5:
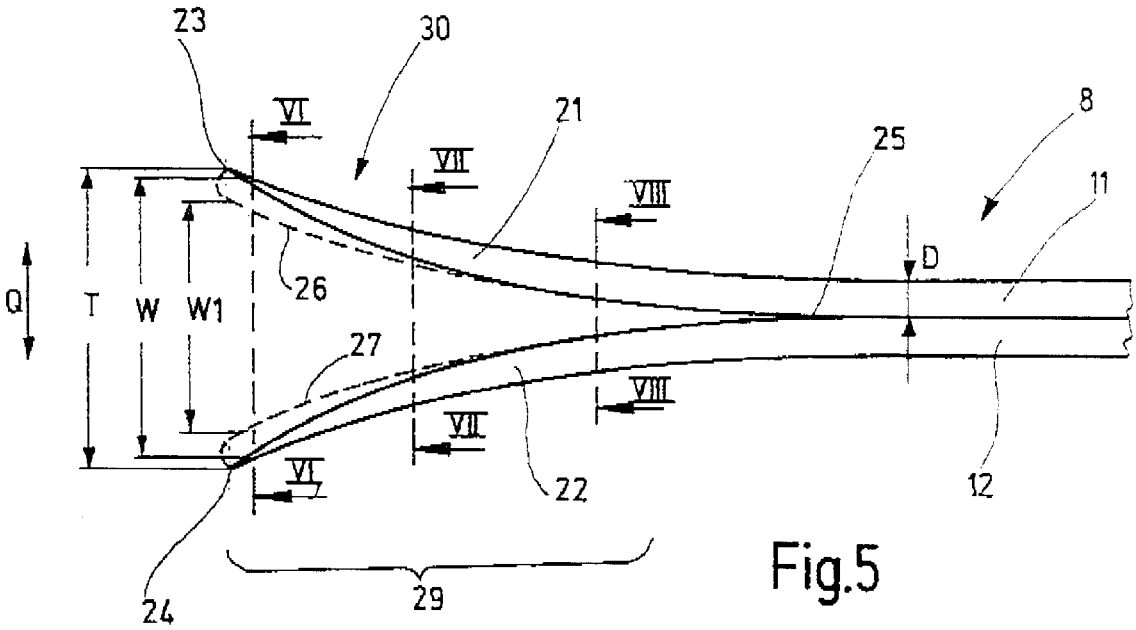
Figure 6:
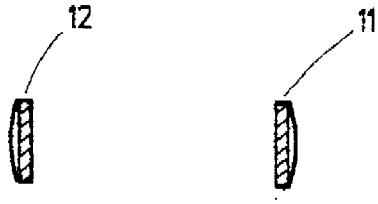
Figure 7:
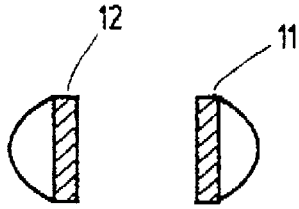
Figure 8:
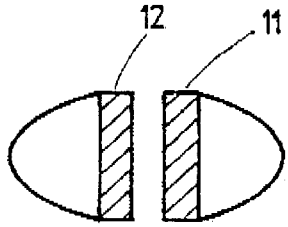
Figure 9:
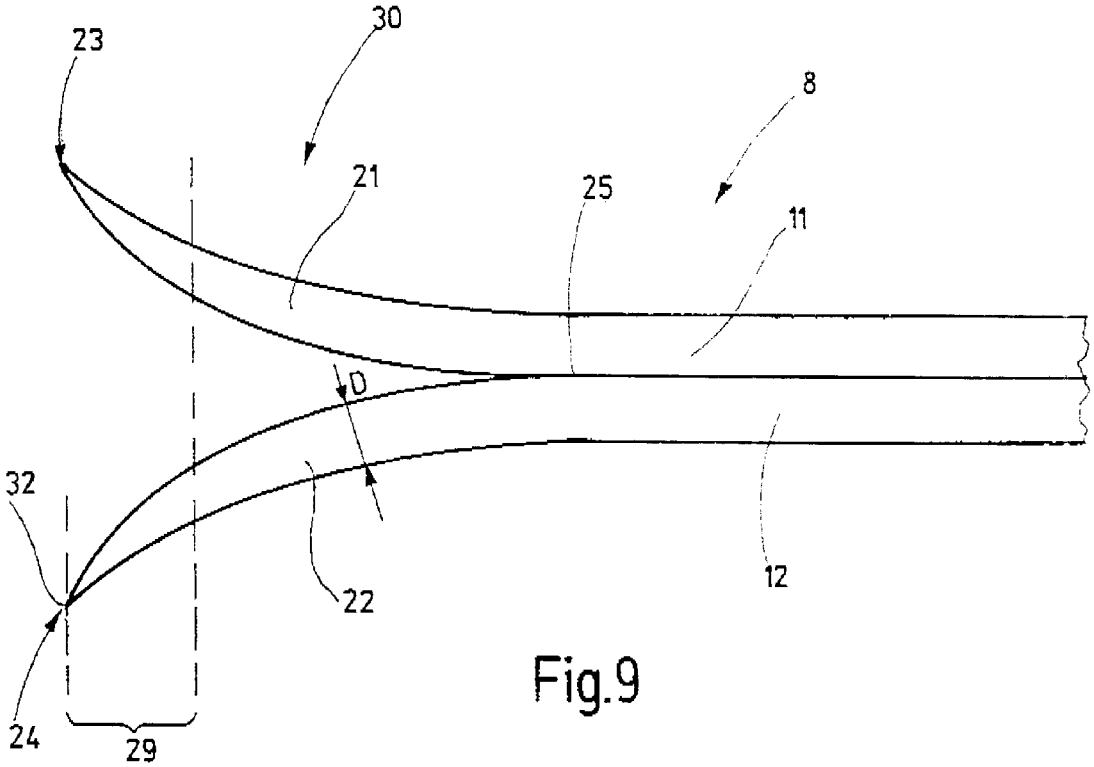
Figure 11:
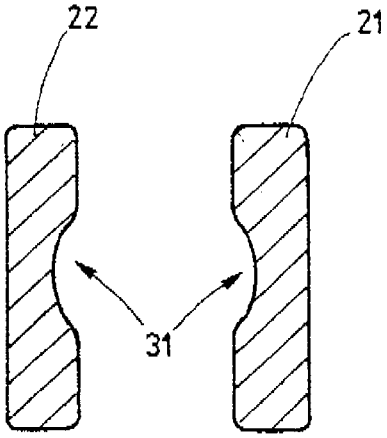
Figure 10:
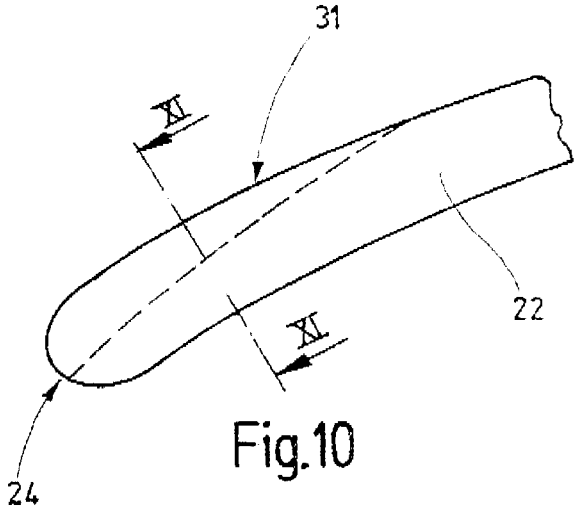

Exemplary embodiments of the invention are illustrated in the drawings. Shown are in:

FIG. 1, the needle in accordance with the invention with an open yarn chamber in a perspective representation, FIG. 2, the needle in accordance with the invention with a closed yarn chamber in a perspective representation, FIG. 3, the needle in accordance with FIGS. 1 and 2 in a view from above, FIG. 4, the slider of the needle in accordance with FIGS. 1 and 2 in a view from above, FIG. 5, the slider of the needle in a schematic enlarged representation, FIGS. 6 to 8, cross sections of the slider springs in accordance with FIG. 5, FIG. 9, a changed embodiment of the slider in a partial view from above, FIG. 10, a further embodiment of a slider spring in a partial view from above, and FIG. 11, a slider with slider springs in accordance with FIG. 10 in a sectional representation.

A compound needle 1 is illustrated in FIG. 1, on the end of whose base body 2 a hook 3 is formed. The tip 5 of the latter points toward a slider slit 4 or slot, which is bordered by two slit walls 6, 7 in the transverse direction Q. A slider 8, part of which are two slider springs 11, 12, is guided in the slide slit 4. The springs are maintained on a slider body 14. The slider can be pushed toward the hook 3 and away from it in a linear direction L. The needle body can be seen in a view from above in FIG. 3. The hook 3 is laterally flattened. In the view from above in FIG. 3, its lateral flanks 16, 17 are arched inward in a bow shape.

The slider 8 can be separately seen in FIG. 4. Its two slider springs 11, 12 substantially rest flat against each other. Optionally they can be arched toward the outside in an area 19 remote from the slider end 18.

The slider end 18 is, defined by two legs 21, 22 of the slider springs 11, 12, which are bent away from each other. Thus the slider springs 11, 12 terminate in ends 23, 24, which are spread away from each other and are maintained at a distance T from each other. The legs 21, 22 start at a contact point 25, where the slider springs 11, 12 just still rest against each other and begin to diverge in order to form a funnel 30.

As can be seen in FIG. 5, the legs 21, 22 taper, starting with a thickness D in a tapering area 29, toward their ends 23, 24. The taper is expressed in a reduction of the width, which should be measured vertically (in the transverse direction Q) in FIG. 5. It starts at the contact point 25 or at a location closer to the ends 23, 24. In the illustrated embodiment, the taper completely includes the entire height of the respective slider spring 11, 12. This can be seen in FIGS. 6 to 8. As the section line VI—VI in FIG. 6 shows, the thickness of the slider springs 11, 12 is relatively small near their ends 23, 24, wherein the cross section of each slider spring 11, 12 is approximately rectangular. The thickness is somewhat greater at a greater distance from the ends 23, 24 (see section line VII—VII in FIG. 7). At an interface close to the contact point 25, the slider springs 11, 12 have already attained their customary thickness, as shown by the section line VIII—VIII (FIG. 8).

At a given distance T of the slider spring ends 23, 24, the flattening of the ends 23, 24, or the legs 21, 22, of the slider springs 11, 12 results in an increased width W of the funnel 30 formed by the legs 21, 22. This is illustrated in FIG. 5. The legs and the ends of slider springs, which do not taper, are shown by dashed lines 26, 27. In the end, these only result in a funnel width W1, which is substantially less than the actually achieved width W.

The compound needle 1 so far described operates as follows:

During operation the needle body 2 and the slider 8 perform a linear movement in respect to each other in the linear direction L, so that a yarn chamber 28, defined by the hook 3 and the slider springs 11, 12, opens and closes. In the course of closing the yarn chamber, the ends 23, 24 of the slider springs 11, 12, which have been spread away from each other, are pushed under the hook 3 on both sides. It is important here that the ends 23, 24 do not collide with the hook tip 5. This is achieved in that the ends 23, 24 define the width W, which is large in comparison with the width of the hook tip 5. At the same time the distance T, which defines the exterior width of the slider 8 at the ends 23, 24, is not, or not substantially, greater than the slider slit 4. Because of this the slider 8 can be easily moved in the slider slit 4, even when the ends 23, 24 have entered the slider slit 4.

If wear occurs during the increase in time the compound needle 1 is used, and/or if the slider 8 is subjected to a lateral pull, the funnel 30 can slightly move laterally because of the play provided and/or the elastic deformation of the slider springs 11, 12. It is therefore no longer completely centered in respect to the needle tip 5. However, because of the great width W of the opening of the funnel 30, the hook tip 5 can find its way between the legs 21, 22 without colliding with the ends 23, 24, even under the most adverse conditions. Therefore the compound needle 1 is wear-resistant and operationally dependable even under adverse conditions. Operational dependability is achieved not at the price of an increase of the friction of the legs 21, 22 in the slider slit 4, because the distance T has not been increased in spite of the increase of the width W in comparison with the conventional funnel width W1. It is even possible to reduce the distance T in case of a merely moderate increase of the width W.

FIG. 9 illustrates a changed embodiment of the slider 8. The ends of the legs 21, 22 of the slider springs 11, 12 are flattened only in the tapered area 29. The tapered area 29 is shorter than the length of the legs 21, 22, which start approximately at the contact point 25. The flattening in the tapered area 29 can be embodied as a flat surface.

In the same way it is possible to embody the flattening not as a flat surface. This is illustrated in FIGS. 10 and 11. FIG. 10 shows the leg 22, which is provided with a depression 31 approximately in its center. As illustrated in FIG. 11, which represents a cross section through the leg 22 at the location XI—XI, as well as a corresponding cross section through the symmetrically embodied leg 21, the tapering is limited to the area of the depression 31, which deepens in the direction toward the end 23, or 24 (FIG. 10). The depression 31 is arranged at a height corresponding to the height of the hook tip 5. Moreover, its orientation corresponds with the orientation of the hook 3.

The slider spring 11, 12, as well as the slider springs 11, 12 of the above described embodiments, terminates at the end 23, 24 in a blunt edge 32. Its rounded shape prevents damage to the yarn.

A compound needle 1 is provided with a slider 8 having two slider springs 11, 12, whose ends constitute an open funnel pointing toward the hook 3. The ends, or legs 21, 22, constituting the funnel, are flattened. Therefore, starting at a starting point, the thickness of the material is reduced in the tapered area 29 toward the ends of the slider springs 11, 12. By means of this a correct functioning of the compound needle is also provided if the slider 8 is not completely centered. Moreover, it is possible to improve the easy movement of the slider 8 in the slider slit in that the funnel, formed by the legs 21, 22, can be embodied to be narrower at a constant width, than without the taper of the slider springs 11, 12.

LIST OF REFERENCE NUMERALS

1 Compound needle
2 Base body
3 Hook
4 Slider slit, slider slot
5 Hook tip
6, 7 Slit walls
8 Slider
11, 12 Slider springs
14 Slider body
16, 17 Lateral flanks
18 Slider end
19 Area
21, 22 Legs
23, 24 Ends
25 Contact point
26, 27 Lines
28 Yarn chamber
29 Tapered area
30 Funnel
31 Depression

32 Edge

T Distance

W Width

W1 Funnel width

Q Transverse direction

L Linear direction

What is claimed is:

1. A compound needle (1), in particular for hoop-forming textile machines, having a needle body (2), whose shank has a hook (3) with a tip (5) at one end, having two slit walls (6, 7) provided on the shank and parallel with each other, which between themselves define a slider slit (4), having a slider (8), which is arranged so it can be displaced in the slider slit (4) and which has at least two slider springs (11, 12), a. whose free legs (21, 22), which point toward the hook (3), are bent away from each other, so that their ends (23, 24) do not touch, in order to form, starting at a contact location (25), a funnel (30) open toward the hook (3), b. whose legs (21, 22) pointing toward the hook (3), taper toward the respective end (23, 24) in a tapering area (29).

2. The compound needle in accordance with claim 1, characterized in that, at least in a front functional section which is used for loop transfer, the slider springs (11, 12) are embodied symmetrically in respect to each other.

3. The compound needle in accordance with claim 1, characterized in that, for tapering the legs (21, 22), the thickness of the legs (21, 22), measured in the transverse direction (Q), is reduced toward the ends (23, 24).

4. The compound needle in accordance with claim 1, characterized in that, measured in the linear direct (L) of the slider (8), the tapered area (29) is shorter than the funnel (30).

5. The compound needle in accordance with claim 1, characterized in that the slider springs (11, 12) are bordered in straight lines over their entire height at each point of their tapered area (29).

6. The compound needle in accordance with claim 1, characterized in that in the tapered area (29) the slider springs (11, 12) have a longitudinally arranged depression (31), at least on their inside.

7. The compound needle in accordance with claim 1, characterized in that at their ends (23, 24) the slider springs (11, 12) have an edge (32), whose radius of curvature is less than half the thickness (D) of the slider springs (11, 12).

* * * * *